US006100754A

United States Patent [19]

Kim et al.

[11] Patent Number: 6,100,754

[45] Date of Patent: Aug. 8, 2000

[54] $V_T$ REFERENCE VOLTAGE FOR EXTREMELY LOW POWER SUPPLY

[75] Inventors: Yong K. Kim, Santa Clara; Yasushi Kasa, Cupertino, both of Calif.

[73] Assignees: Advanced Micro Devices, Inc., Sunnyvale, Calif.; Fujitsu Limited, Japan

[21] Appl. No.: 09/128,024

[22] Filed: Aug. 3, 1998

[51] Int. Cl.[7] ..... G05F 3/02

[52] U.S. Cl. ..... 327/541; 327/546

[58] Field of Search ..... 327/530, 534, 327/535, 537, 539, 540, 541, 543, 545, 546

[56] References Cited

U.S. PATENT DOCUMENTS

| | | | |
|---|---|---|---|
| 5,126,653 | 6/1992 | Ganesan | 323/313 |
| 5,869,997 | 2/1999 | Tomishima | 327/543 |
| 5,900,773 | 5/1999 | Susak | 327/539 |
| 5,936,392 | 8/1999 | Taylor | 323/315 |
| 5,949,277 | 9/1999 | Iravani | 327/541 |
| 5,955,874 | 9/1999 | Zhou et al. | 323/315 |

*Primary Examiner*—Jeffrey Zweizig
*Attorney, Agent, or Firm*—Davis Chin

[57] ABSTRACT

A reference voltage generator circuit is provided for use with an extremely low power supply voltage. The reference voltage generator circuit produces a lower reference output voltage which is compensated for temperature variations and is independent of changes in the supply voltage. The reference output voltage relies upon the threshold voltage $V_T$ of a MOSFET transistor as a reference source.

11 Claims, 1 Drawing Sheet

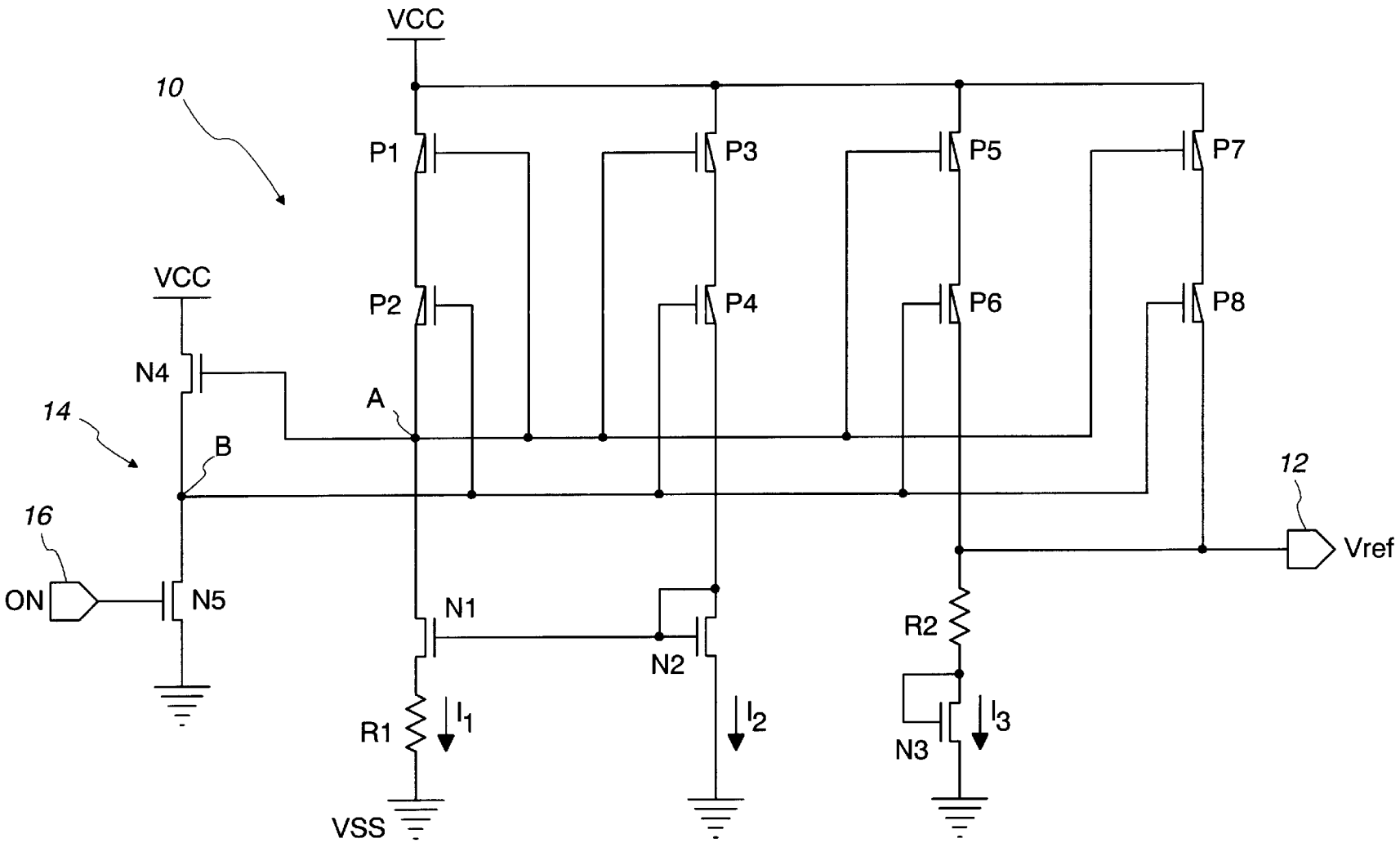
Vref
12
P7
P8
P5
P6
P3
P4
P1
P2
VCC
A
B
R2
N3
N2
N1
R1
VSS
I3
I2
I1
10
14
16
VCC
N4
N5
ON

$V_T$ REFERENCE VOLTAGE FOR EXTREMELY LOW POWER SUPPLY

BACKGROUND OF THE INVENTION

1. Field of the Invention

This invention relates generally to reference voltage generator circuits and more particularly, it relates to an improved reference voltage generator circuit for use with an extremely low power supply which is compensated for temperature variations and is independent of changes in the supply voltage.

2. Description of the Prior Art

As is generally known, virtually all types of electronic circuits utilizing integrated circuits require reference voltages. It is typically desired that the reference voltage be constant under all operating conditions and have essentially no temperature drift or a defined temperature drift. One type of prior art reference voltage circuit that produces such a constant voltage is referred to as a "bandgap" reference voltage circuit. The reference voltage generated by such a bandgap circuit is temperature-independent of the circuit components used and corresponds to the bandgap of a semiconductor material. Frequently, the semiconductor material used is silicon and thus furnishes a temperature-independent reference voltage of approximately 1.205 volts. Further, this bandgap circuit relies upon the use of the base-to-emitter voltage $V_{be}$ (with a negative temperature coefficient) of a bipolar transistor as a reference which is compensated for through a voltage having a positive temperature coefficient that is added.

However, these existing prior art bandgap reference voltage circuits suffer from the principal disadvantage that they will not operate when the power supply voltage VCC is reduced down to an extremely low voltage such as 1 volt. In view of the trend for deep-submicron CMOS technology, lower and lower supply voltages are being used. Further, the regulated output voltage from the bandgap circuit has the added drawback of only being able to produce a reference voltage equal to about 1.205 volts or a multiple thereof.

Therefore, it would be desirable to provide a reference voltage generator circuit which is adapted for use with an extremely low power supply voltage. Further, it would be expedient that the reference voltage generator circuit produce a low output voltage which is temperature-compensated and is independent of variations in the power supply voltage.

SUMMARY OF THE INVENTION

Accordingly, it is a general object of the present invention to provide an improved reference voltage generator circuit which is relatively simple and economical to manufacture and assemble, but yet overcomes the disadvantages of the prior art bandgap reference circuits.

It is an object of the present invention to provide an improved reference voltage generator circuit whose operation is compensated to produce a lower output reference voltage that is independent of variations in temperature and power supply voltage.

It is another object of the present invention to provide an improved reference voltage generator circuit which produces a low output reference voltage of approximately 700 millivolts with an extremely low power supply voltage of about 1.0 volts and which is temperature and supply compensated.

It is still another object of the present invention to provide an improved reference voltage generator circuit which relies upon the threshold voltage $V_T$ of a MOSFET transistor as a reference source.

In accordance with these aims and objectives, the present invention is concerned with the provision of a reference voltage generator circuit for use with an extremely low power supply voltage for producing a lower reference output voltage which is compensated for variations in temperature and power supply voltage. The reference voltage generator circuit includes first and second parallel current branches for generating a first voltage across a first resistor which has a positive temperature coefficient and is independent of variations in the power supply voltage. A third parallel current branch includes a second resistor and an N-channel MOSFET transistor having a negative temperature coefficient. The third parallel current branch is used to generate the lower reference output voltage. A second voltage is developed across the second resistor which is proportional to the first voltage with the positive temperature coefficient.

BRIEF DESCRIPTION OF THE DRAWINGS

These and other objects and advantages of the present invention will become more fully apparent from the following detailed description when read in conjunction with the accompanying drawing in which there is shown a schematic circuit diagram of the improved reference voltage generator circuit for use with an extremely low power supply voltage of the instant invention.

DESCRIPTION OF THE PREFERRED EMBODIMENT

Referring now in detail to the drawing of the particular illustration, there is shown a schematic circuit diagram of an improved reference voltage generator circuit 10, constructed in accordance with the principles of the present invention. The reference voltage generator circuit 10 of the present invention provides a lower reference output voltage (I.E., 700 millivolts) that is compensated for temperature variations and is independent of changes in the power supply voltage. The instant reference voltage generator circuit has particular application for use with an extremely low power supply voltage of approximately 1 volt. Unlike the prior art bandgap circuits, the reference voltage generator circuit 10 will be fully operational at the extremely low power supply voltage and relies upon the $V_T$ of a MOSFET transistor as a reference source.

The reference voltage generator circuit 10 includes two parallel current branches which are connected between a first power supply potential VCC and a second power supply potential VSS. The first power supply potential is an extremely low voltage of approximately +1.0 volts ±10%, and the second power supply potential is typically at ground potential or zero volts. The first branch is formed of P-channel MOSFET transistors P1, P2; an N-channel MOSFET transistor N1; and a resistor R1. The second branch is formed of P-channel MOSFET transistors P3, P4, and an N-channel MOSFET transistor N2.

In the first branch, the P-channel transistor P1 has its source connected to the power supply potential VCC and its drain connected to the source of the P-channel transistor P2. The transistor P2 has its drain connected to the drain of the N-channel transistor N1 at a first node A. The source of the transistor N1 is connected to one end of the resistor R1, and the other end of the resistor R1 is connected to the second power supply potential VSS.

In the second branch, the P-channel transistor P3 has its source connected also to the first power supply potential VCC and its drain connected to the source of the P-channel transistor P4. The transistor P4 has its drain connected to the drain of the N-channel transistor N2. The drain of the transistor N2 is further connected to its gate and to the gate of the N-channel transistor N1. The source of the transistor N2 is connected to the second power supply potential VSS.

The reference generator circuit 10 further includes a third parallel current branch connected also between the first and second power supply potentials. The third branch is formed by P-channel MOSFET transistors P5, P6; a resistor R2; and an N-channel MOSFET transistor N3. The P-channel transistor P5 has its source connected also to the first power supply potential VCC and its drain connected to the source of the P-channel transistor P6. The transistor P6 has its drain connected to one end of the resistor R2 and to an output terminal 12 for generating a lower output reference voltage $V_{ref}$. The reference voltage $V_{ref}$ is approximately 700 millivolts with the low power supply voltage of about 1 volt. The other end of the resistor R2 is connected to the drain of the N-channel transistor N3. The transistor N3 has its drain also connected to its gate and its source connected to the second power supply potential VSS.

The conduction paths (source/drain) of two series-connected P-channel MOSFET transistors P7 and P8 are further connected in parallel across the series-connected P-channel transistors PS and P6. In particular, the P-channel transistor P7 has its source connected to the source of the transistor P5 and its drain connected to the source of the transistor P8. The drain of the transistor P8 is connected to the drain of the transistor P6, the one end of the resistor R2, and the output terminal 12.

The reference generator circuit 10 further includes a gate-bias circuit portion 14 which is formed by N-channel MOSFET transistors N4 and N5. The transistor N4 has its drain connected to the first power supply potential VCC and its source connected to the drain of the transistor N5 at a second node B. The transistor N5 has its source connected to the second power supply potential VSS and its gate connected to an input terminal 16 for receiving a signal ON. The gate of the transistor N4 is also connected to the first node A and to all of the gates of the P-channel transistors P1, P3, P5 and P7. The second node B at the junction of the source of the transistor N4 and the drain of the transistor N5 is connected to all of the gates of the P-channel transistors P2, P4, P6 and P8.

The operation of the reference generator circuit 10 will now be explained as to how the reference output voltage $V_{ref}$ is generated so as to be compensated for both variations in temperature and power supply voltage. Initially, the current flowing through the resistor R1 is defined to be $I_1$ and the current flowing in the source of the transistor N2 is defined to be $I_2$. The transconductance curves for the currents $I_1$ and $I_2$ are given by the following equations:

$$I_1=k_1(V_{gs1}-V_{t1})^2 \tag{1}$$

and $$I_2=k_2(V_{gs2}-V_{t2})^2 \tag{2}$$

where $k_1$ is a constant for transistor N1

$V_{gs1}$ is gate-to-source voltage for transistor N1

$V_{t1}$ is threshold voltage for transistor N1

$k_2$ is a constant for transistor N2

$V_{gs2}$ is gate-to source voltage for transistor N2

$V_{t2}$ is threshold voltage for transistor N2

By solving above equations (1) and (2) for $V_{gs1}$ and $V_{gs2}$ respectively, there can be obtained:

$$V_{gs1} = \sqrt{I_1/k_1} + V_{t1} \tag{3}$$

and $$V_{gs2} = \sqrt{I_2/k_2} + V_{t2} \tag{4}$$

The voltage across the resistor $V_{R1}$ can be expressed as follows:

$$V_{R1}=V_{gs2}-V_{gs1} \tag{5}$$

By substituting above equations (3) and (4) into equation (5), there is given:

$$V_{R1} = \sqrt{I_2/k_2} + V_{t2} - \left(\sqrt{I_1/k_1} + V_{t1}\right) \tag{6}$$

Since the transistors N1 and N2 are connected as a current mirror arrangement, then the current $I_1$ will be equal to the current $I_2$, which can be represented simply by I. Further, if it is assumed that the threshold voltage of the transistors N1 and N2 are equal or $V_{t1}\approx V_{t2}$, then equation (6) can be simplified to the following:

$$V_{R1} = \sqrt{I/k_2} - \sqrt{I/k_1} \tag{7}$$

By factoring out $\sqrt{I}$ in equation (7), there is given:

$$V_{R1} = \sqrt{I}\left(\frac{1}{\sqrt{k_2}} - \frac{1}{\sqrt{k_1}}\right) \tag{8}$$

In general, the transconductance parameter k can be expressed as follows:

$$k = \mu\frac{\epsilon_{ox}}{t_{ox}}\cdot\frac{W}{L} \tag{9}$$

where $\mu$ is the mobility of electrons $\epsilon$ is the permittivity of gate oxide $t_{ox}$ is the thickness of gate oxide W is the width of gate of a transistor L is the length of gate of a transistor If $W_1/L_1$ and $W_2/L_2$ are defined to be the width/length ratios of the respective transistors N1 and N2, then by substitution of equations (9) into equation (8) and factoring, there is given:

$$V_{R1} = \sqrt{I}\left(\frac{1}{\sqrt{\mu\epsilon_{ox}/t_{ox}}}\right)\left(\frac{1}{\sqrt{W_2/L_2}} - \frac{1}{\sqrt{W_1/L_1}}\right) \tag{10}$$

If it is further assumed that the length of the gates of the transistors N1 and N2 are equal ($L_1\equiv L_2$), which can be simply represented by L, the above equation (10) can be further simplified to:

$$V_{R1} = \sqrt{IL}\left(\frac{1}{\sqrt{\mu\epsilon_{ox}/t_{ox}}}\right)\left(\frac{1}{\sqrt{W_2}} - \frac{1}{\sqrt{W_1}}\right) \quad (11)$$

By Ohm's law, the current I or $I_1$ can be expressed by:

$$I=I_1=V_{R1}/R_1 \quad (12)$$

Due to the current mirror transistors N1, N2 the same current I will be caused to flow through the branch transistors P1, P2 and the branch transistors P3, P4. This same current I will be transferred to the series-connected branch transistors P5, P6. Also, the series-connected transistors P7, P8 are connected in parallel with the branch transistors P5, P6. Thus, the current flowing through the transistors P5, P6 and transistors P7, P8 are equal to the current I.

Due to the current mirror arrangement of the transistors P2, P6 and transistors P2, P8, the current $I_3$ flowing through the transistor N3 will be equal to:

$$I_3=2I_1 \quad (13)$$

By Kirchoff's voltage law, the reference output voltage $V_{ref}$ at the output terminal 12 is given as follows:

$$V_{ref}=V_{gs3}+I_3R_2 \quad (14)$$

where $V_{gs3}$ is threshold voltage for transistor N3

By substituting equations (13) and (12) into equation (14), there is given:

$$V_{ref} = V_{gs3} + R_2(2V_{R1}/R_1) = V_{gs3} + \frac{2R_2}{R_1}\cdot V_{R1} \quad (15)$$

It should be understood by those skilled in the art that both the threshold voltage $V_{gs}$ of a MOSFET transistor and the mobility factor $\mu$ have a negative temperature coefficient. Thus, as temperature increases, both the threshold voltage $V_{gs3}$ and the mobility factor $\mu$ decrease. However, as can be seen from equation (11), the mobility $\mu$ is in the denominator and will cause the voltage $V_{R1}$ to increase as a function of temperature or have a positive temperature coefficient. On the other hand, as temperature decreases both the threshold voltage $V_{gs3}$ and the mobility $\mu$ will increase, but the voltage $V_{R1}$ will decrease. As a result, the reference output voltage in above equation (15) will be compensated over variations in temperature since the first term $V_{gs3}$ has a negative temperature coefficient and the factor $V_{R1}$ in the second term has a positive temperature coefficient.

In order to produce a stable reference output voltage $V_{ref}$ on the output terminal 12 the current I flowing through the transistors N1 and N2 must be further maintained constant over variations in the power supply voltage VCC, as can be seen from equations (15) and (11). Since the amount of current flowing through the P-channel transistors P2 and P4 is dependent upon the voltage applied across the source/drain conduction paths, the voltage $V_{ds}$ across the transistors P2 and P4 must be made to be substantially constant. If it were not for the P-channel transistors P1 and P3, the voltage $V_{ds}$ across the transistors P2 and P4 would be subject to changes due to the power supply variations. By provision of the transistors P1 and P3, the voltage $V_{ds}$ across the transistors P2 and P4 do not change. Since there is no change in the voltages $V_{ds}$, the current I will not change. Therefore, the reference output voltage $V_{ref}$ will be constant over variations in the power supply voltage.

In other words, the power supply compensation is provided by connecting the gates of the transistors P1 and P3 to the gate of the N-channel transistor N4 at the first node A in the gate-bias circuit portion 14 so as to cause the voltage $V_{ds}$ across the transistors P1 and P3 to track with variations in the power supply potential VCC. In operation, for example, as the power supply potential VCC increases the voltage $V_{ds}$ across the transistor N4 will be increased. It will be noted that the signal ON is high during normal operation so as to cause the transistor N5 to be turned on and pulling its drain at the second node B to the ground potential. This ground potential is also connected to the gates of the transistors P2 and P4. Also, the increased power supply potential VCC will cause an increased current to flow through the transistors P1 and P3. However, the gate-to-source voltage $V_{gs4}$ of the transistor N4 will be increased due to the higher power supply potential, thereby causing a higher gate-bias voltage at the first node A so as to reduce the current flowing through the transistors P1 and P3. As a consequence, the currents flowing through the transistors P2 and P4 will remain unchanged due to supply variations.

From the foregoing detailed description, it can thus be seen that the present invention provides an improved reference voltage generator circuit for use with an extremely low power supply. The present reference voltage generator circuit provides a lower reference output voltage which is compensated for temperature variations and is independent of changes in the supply voltage. The reference output voltage relies upon the threshold voltage $V_t$ of a MOSFET transistor as a reference source.

While there has been illustrated and described what is at present considered to be a preferred embodiment of the present invention, it will be understood by those skilled in the art that various changes and modifications may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as the best mode contemplated for carrying out the invention, but that the invention will include all embodiments falling within the scope of the appended claims.

What is claimed is:

1. A reference voltage generator circuit for use with an extremely low first power supply potential for producing a lower reference output voltage which is compensated for variations in temperature and the power supply potential, said reference voltage generator circuit comprising:

first and second parallel current branches connected between the extremely low first power supply potential and a second power supply potential, said first branch including a first P-channel MOSFET transistor, a second P-channel MOSFET transistor, a first N-channel MOSFET transistor and a first resistor connected in series, said second branch including a third P-channel MOSFET transistor, a fourth P-channel MOSFET transistor, and a second N-channel MOSFET transistor connected in series, said first resistor having a first voltage developed thereacross with a positive temperature coefficient;

a third parallel current branch connected also between the first extremely low power supply potential and the second power supply potential, said third branch including a fifth P-channel MOSFET transistor, a sixth P-channel MOSFET transistor, a second resistor and a third N-channel MOSFET transistor connected in series, said third N-channel MOSFET transistor having a second voltage with a negative temperature coefficient;

a fourth branch formed of a seventh P-channel MOSFET transistor and an eighth P-channel MOSFET transistor being connected in series, said fourth branch being connected in parallel across the conduction path of said fifth and sixth P-channel MOSFET transistors;

gate-bias circuit means for generating a first gate-bias voltage connected to the gates of said first, third, fifth and seventh P-channel transistors and a second gate-bias voltage connected to the gates of said second, fourth, sixth and eighth P-channel transistors so as to maintain constant the current flowing through said first and second P-channel transistors as variations in the power supply potential occurs; and said second resistor and said third N-channel transistor establishing the lower reference output voltage which is temperature and power supply compensated.

2. A reference voltage generator circuit as claimed in claim 1, wherein said first power supply potential is approximately 1.0 volts, and said second power supply potential is zero volts.

3. A reference voltage generator circuit as claimed in claim 1, wherein the second voltage of said third N-channel transistor is defined by its threshold voltage.

4. A reference voltage generator circuit as claimed in claim 1, wherein said first P-channel transistor has its source connected to the first power supply potential and its drain connected to the source of said second P-channel transistor, said first N-channel transistor having its drain connected to the drain of said second P-channel transistor and its source connected to one end of said first resistor, said first resistor having its other end connected to the second power supply potential.

5. A reference voltage generator circuit as claimed in claim 4, wherein said third P-channel transistor having its source connected to the first power supply potential and its drain connected to the source of said fourth P-channel transistor, said second N-channel transistor having its drain connected to the drain of said fourth P-channel transistor, to its gate and to the gate of said first N-channel transistor, the source of said second N-channel transistor being connected to the second power supply potential.

6. A reference voltage generator circuit as claimed in claim 5, wherein said fifth P-channel transistor has its source connected to the first power supply potential and its drain connected to the source of the sixth P-channel transistor, said second resistor having its one end connected to the drain of said sixth P-channel transistor and to an output terminal for generating the reference output voltage and its other end connected to the drain and gate of said third N-channel transistor, the source of said third N-channel transistor being connected to the second power supply potential.

7. A reference voltage generator circuit as claimed in claim 6, wherein said seventh P-channel transistor has its source connected to the first power supply potential and its drain connected to the source of said eighth transistor, said eighth transistor having its drain connected to the drain of said sixth transistor, the one end of the second resistor, and the output terminal.

8. A reference voltage generator circuit as claimed in claim 7, wherein said gate-bias circuit portion includes a fourth N-channel transistor and a fifth N-channel transistor connected in series between the first power supply potential and the second power supply potential.

9. A reference voltage generator circuit as claimed in claim 8, wherein said fourth N-channel transistor has its drain connected to the first power supply potential, its source connected to the drain of said fifth N-channel transistor, said fifth N-channel transistor having its source connected to the second power supply potential.

10. A reference voltage generator circuit as claimed in claim 9, wherein said gate of said fourth N-channel transistor defines the first gate-bias voltage connected to the gates of said first, third, fifth and eighth transistors, and wherein said drain of said fifth transistor defines the second gate-bias voltage connected to the gates of said second, fourth, sixth and eighth P-channel transistors.

11. A reference voltage generator circuit for use with an extremely low first power supply potential for producing a lower reference output voltage which is compensated for variations in temperature and the power supply potential, said reference voltage generator circuit comprising:

first current circuit means including a first resistor for generating a first voltage developed across said first resistor which has a positive temperature coefficient and is independent of variations in the power supply voltage;

said first current circuit means including gate-bias circuit means for maintaining the current flowing through said first resistor to be constant with power supply variations;

second current circuit means including a second resistor and an N-channel MOSFET transistor having a negative temperature coefficient for generating the lower reference output voltage, said second resistor having a second voltage developed thereacross which is proportional to said first voltage with the positive temperature coefficient;

said N-channel MOSFET transistor having a threshold voltage with the negative temperature coefficient;

said N-channel transistor having its drain and gate connected together and to one end of said second resistor and its source connected to a around potential, the other end of said second resistor being connected to an output terminal for generating the lower reference output voltage; and said gate-bias circuit means including a second N-channel MOSFET transistor and a third N-channel MOSFET transistor connected in series between the extremely low first power supply potential and a second power supply potential.

* * * * *

UNITED STATES PATENT AND TRADEMARK OFFICE

CERTIFICATE OF CORRECTION

PATENT NO : 6,100,754

DATED : August 8, 2000

INVENTOR(S): Yong K. Kim; Yasushi Kasa

It is certified that error appears in the above-identified patent and that said Letters Patent are hereby corrected as shown below:

Column 4, line 2, change "gate-to source" to – gate-to-source –.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*